US011517917B2

(12) United States Patent
Heinovaara

(10) Patent No.: US 11,517,917 B2
(45) Date of Patent: Dec. 6, 2022

(54) ELECTROSTATIC FILTER AND A RACK FOR FILTER PLATES OF AN ELECTROSTATIC FILTER

(71) Applicant: Alme Solutions Oy, Tampere (FI)

(72) Inventor: Jari Heinovaara, Sarkola (FI)

(73) Assignee: Alme Solutions Oy, Tampere (FI)

( * ) Notice: Subject to any disclaimer, the term of this patent is extended or adjusted under 35 U.S.C. 154(b) by 527 days.

(21) Appl. No.: 16/492,178

(22) PCT Filed: Feb. 22, 2018

(86) PCT No.: PCT/FI2018/050129
§ 371 (c)(1),
(2) Date: Sep. 9, 2019

(87) PCT Pub. No.: WO2018/162792
PCT Pub. Date: Sep. 13, 2018

(65) Prior Publication Data

US 2020/0246808 A1 Aug. 6, 2020

(30) Foreign Application Priority Data

Mar. 10, 2017 (FI) ..... 20175224

(51) Int. Cl.
*B03C 3/41* (2006.01)
*B03C 3/12* (2006.01)
(Continued)

(52) U.S. Cl.
CPC ..... *B03C 3/41* (2013.01); *B03C 3/12* (2013.01); *B03C 3/08* (2013.01); *B03C 3/47* (2013.01);
(Continued)

(58) Field of Classification Search
CPC combination set(s) only.
See application file for complete search history.

(56) References Cited

U.S. PATENT DOCUMENTS 2,542,262 A * 2/1951 Richardson ..... B03C 3/86 96/86
2,714,939 A * 8/1955 Richardson ..... B03C 3/47 96/86
(Continued)

FOREIGN PATENT DOCUMENTS

CA 1202930 A * 8/1970
CN 205436028 U 8/2016
(Continued)

OTHER PUBLICATIONS

Japanese Office Action for JP Application No. 2019-571106 dated Sep. 8, 2021 (8 pages with English translation).

*Primary Examiner* — Christopher P Jones
*Assistant Examiner* — Sonji Turner
(74) *Attorney, Agent, or Firm* — Merchant & Gould P.C.

(57) ABSTRACT

The invention relates to a rack (21, 27, 28) for supporting electrostatic filter plates (22, 23) of an electrostatic filter (20). The rack (21, 27, 28) is an elongated member comprising a plurality of notches (11) on a longitudinal side of the rack (21, 27, 28) for supporting a plate (22, 23) arranged to a notch (11). The rack (21, 27, 28) further comprises a slot (26) for adhesive arranged to be used at least for attaching the plates (22, 23) to the rack (21, 27, 28). The slot (26) is arranged on the opposite side of the rack (21, 27, 28) than notches (11). There is also an opening (24) in the first group of plates (22) at that point where the plates (22) are aligned with the voltage supply rack (28) but which are not attached to that rack (28). The invention further relates to an electrostatic filter (20) comprising a plurality of racks.

6 Claims, 5 Drawing Sheets

(51) Int. Cl.
*B03C 3/08* (2006.01)
*B03C 3/47* (2006.01)
*B03C 3/86* (2006.01)

(52) U.S. Cl.
CPC ..... *B03C 3/86* (2013.01); *B03C 2201/04* (2013.01); *B03C 2201/06* (2013.01); *B03C 2201/10* (2013.01)

(56) References Cited

U.S. PATENT DOCUMENTS 2,873,000 A * 2/1959 Elam ..... B03C 3/86 96/77
3,016,980 A * 1/1962 Gonzalez ..... B03C 3/12 96/76
3,017,952 A * 1/1962 Westlin ..... B03C 3/86 96/86
3,685,258 A * 8/1972 Kostel ..... B03C 3/32 96/63
3,729,815 A 5/1973 Quintilian et al.
3,835,623 A 9/1974 Kline
4,559,064 A 12/1985 Ahern
5,547,496 A * 8/1996 Hara ..... B03C 3/025 96/79
5,993,521 A * 11/1999 Loreth ..... B03C 3/62 96/69
9,795,971 B2 * 10/2017 Shao ..... B03C 3/41
2017/0354978 A1 * 12/2017 Krichtafovitch ..... B03C 3/12

FOREIGN PATENT DOCUMENTS

FR 1304266 A 9/1962
GB 1450255 A * 9/1976 ..... B03C 3/47
JP S5251173 A 4/1977
JP S5251174 A 4/1977
JP S59135147 U 9/1984
JP H0291647 U 7/1990
JP H08173845 U 7/1996
JP H0985125 A 3/1997
JP 2004174456 A 6/2004
JP 2008296127 A 12/2008
JP 2010069348 A 4/2010
JP 2011020075 A 2/2011

* cited by examiner

ELECTROSTATIC FILTER AND A RACK FOR FILTER PLATES OF AN ELECTROSTATIC FILTER

PRIORITY

This application is a U.S. national application of the international application number PCT/FI2018/050129 filed on Feb. 22, 2018 and claiming priority of Finnish application 20175224 filed on Mar. 10, 2017 the contents of all of which are incorporated herein by reference.

TECHNICAL FIELD

The present invention relates to a rack to be used in an electrostatic filter structure. Furthermore, the invention relates to an electrostatic filter comprising several racks.

BACKGROUND

Different kind of electrostatic precipitators (ESP) are used for separating particles from an air stream. An air purification device comprising such a filter is commonly marketed to the public. An air purification device can be, for example, arranged in an air duct or it may be a portable device. These filters comprise a particle charging unit and a particle collector unit. The particle charging unit comprises, for example, at least one corona wire or corona needle for ionizing or charging the particles existing in the air stream with an electronic charge. The particle collector unit comprises an electrostatic plate stack that is arranged downstream relative to the particle charging unit. In the particle collector unit an electrical field is produced by plates charged with an opposite electrical charge. Charged particles are collected and removed from the air stream when they pass through the stack of plates of the particle collector unit and collide with the plates. Plates are usually made of metal or suitable polymer material and arranged into frame structures as stack of plates.

SUMMARY

It is an aim of the present invention to provide a rack that is a supporting rack suitable to be used in a filter structure and to provide a filter structure comprising a plurality of racks as a supporting structure for plates. The rack may also act as a voltage connecting mean.

According to a first embodiment, there is provided a rack for supporting filter plates of a frameless filter and supplying electric voltage. The rack is an elongated member comprising a plurality of notches on a longitudinal side of the rack for supporting a plate arranged to a notch and comprising a connecting structure in both ends of the rack for connecting the rack to supporting structures of the frameless filter. The rack further comprises a slot for adhesive arranged to be used at least for attaching the plates to the rack. The slot is arranged on the opposite side of the rack than notches.

According to an embodiment, the rack is made of plastic. According to an embodiment, the rack is made of electrically non-conductive material. According to an embodiment, the rack is made of electrically conductive material. According to an embodiment, the filter plates are arranged to be attached to the rack by adhesive in the slot. According to an embodiment, the rack is further arranged to act as an electric voltage supply rack for filter plates. According to an embodiment, the filter plates are arranged to be attached to the rack by electrically conductive adhesive. According to an embodiment, the supporting structures are covers above and under the frameless electrostatic filter. According to an embodiment, the rack further comprises at least one electrical connector.

According to a second embodiment, there is provided a frameless electrostatic filter comprising a plurality of racks and a plurality of electrically conductive filter plates arranged as a stack one on the other. The rack is an elongated member comprising a plurality of notches on a longitudinal side of the rack for supporting a plate arranged to a notch. The rack further comprises a slot for adhesive arranged to be used at least for attaching the plates to the rack. The slot is arranged on the opposite side of the rack than notches.

A first part of the filter plates are arranged into a first electric potential and a second part of the filter plates are arranged into a second electric potential. A first part of the racks are arranged to support only the first part of the filter plates and a second part of the racks are arranged to support only the second part of the filter plates so that each rack supports a plurality of filter plates and each plate is supported by a plurality of racks. Every other filter plate of the stack is arranged into the first electric potential and every other into the second electric potential so that an electric field is formed between filter plates. There is an opening in the plates at that point where the plates are aligned with a rack, but are not arranged to be attached to that rack, and wherein at least one rack of the first part of the racks is arranged to supply first electric voltage to the first part of the plates and at least one rack of the second part of the racks is arranged to supply second electric voltage to the second part of the plates, wherein the second electric voltage may mean grounding of the second part of the plates. The frameless electrostatic filter comprises a supporting structure above and under the filter According to an embodiment, the rack is made of plastic. According to an embodiment, the rack is made of electrically non-conductive or conductive material. According to an embodiment, the filter plates are arranged to be attached to the rack by adhesive in the slot. According to an embodiment, the rack that is further arranged to act as an electric voltage supply rack for filter plates. According to an embodiment, the filter plates are arranged to be attached to the rack by electrically conductive adhesive. According to an embodiment, the rack further comprises a connecting structure in both ends of the rack for connecting the rack to a supporting structure on an electrostatic filter. According to an embodiment, electrically conductive adhesive is used in a slot of racks arranged to provide electric voltage for plates. According to an embodiment, electrically non-conductive adhesive is used for attaching plates to a slot of racks arranged to support plates. According to an embodiment, the rack further comprises at least one electrical connector. According to an embodiment, the filter has a shape of rectangular, cubic, half oval, oval, triangular, a half circle or circular. According to an embodiment, the filter is suitable to be connected to another electrostatic filter for forming a combined electrostatic filter having a shape of rectangular, cubic, oval, triangular or circular. According to an embodiment, the filter is suitable to be connected to another electrostatic filter so that a right-angle is formed so that both electrostatic filters form a half of the corner structure of the combined electrostatic filter. According to an embodiment, racks arranged to provide electric voltage for plates are arranged inside the combined electrostatic filter.

BRIEF DESCRIPTION OF THE DRAWINGS

In the following, various embodiments of the invention will be described in more detail with reference to the appended drawings, in which.

DETAILED DESCRIPTION

Figure 1:
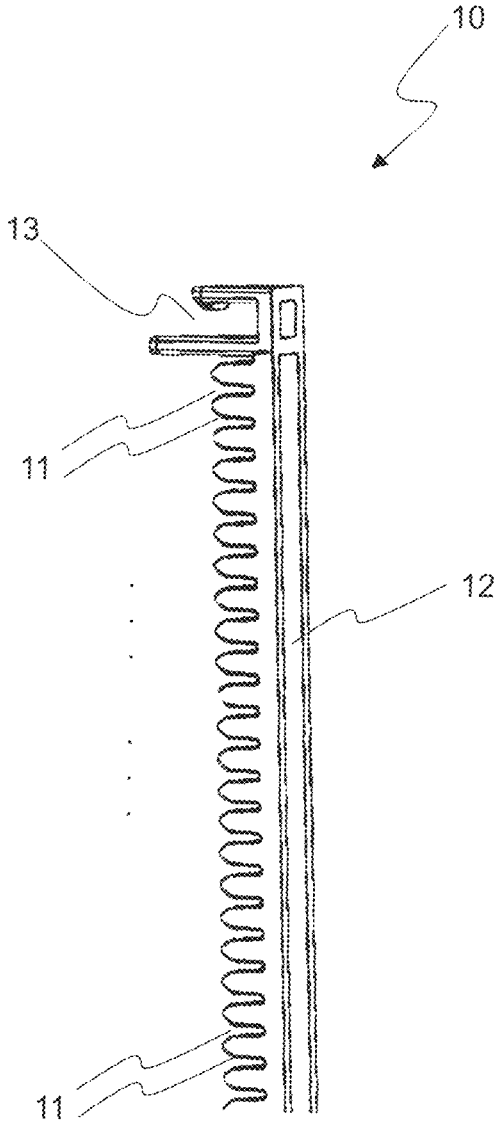
FIG. 1 shows a rack of an electrostatic filter of an air purification device according to an embodiment of the invention in a perspective view.

An example of a filter structure according to embodiments of the invention is an electrostatic filter, for example, an electrostatic precipitator (ESP) suitable to be used in an air purification device or a gas filter. In this connection, the air purification device may be a supply air device, an air cleaning device, an air conditioning device or any other device using a filtering structure for separating and removing particles and other impurities from a gas stream. The gas stream may be, for example, an air stream.

An electrostatic filter structure according to the invention for an air purification device comprises at least one particle charging unit and at least one electrostatic filter. The particle charging unit may comprise, for example, at least an ionizer i.e. a corona charger, for example, one or more corona needles or one or more corona wires for ionizing or charging the particles existing in the gas stream with an electric charge. It is also possible that other type of particle charging is used instead of corona wires or needles. The particle charging unit may also refer to a device installed on the upstream of the filter i.e. front side of the filter or a device which is integrated in the filter. The air flow entering the filter is ionized before it enters the actual electrostatic filter of the electrostatic filter structure so that the particles in the gas stream that are electrically charged can thus be removed from the gas stream by means of the electrostatic filter. A high voltage ionizer charging the particles of gas stream flowing through the electrostatic filter can also produce minimal amounts of ozone. At these small levels it should not increase system corrosion or lead to increased allergen levels or asthma. However, when corona needles are used instead of corona wires it is possible that even smaller amounts of ozone are produced. The particle charging unit according to an embodiment of the invention may comprise, for example, at least one, but also 2 to 8 or even more corona needles.

The electrostatic filter itself according to embodiments of the invention is a particle collector unit comprising two groups of plate-like elements i.e. electrostatic filter plates arranged essentially parallel between each other at a predetermined distance from each other and essentially parallel to the flow direction of a gas stream arranged to be purified by the electrostatic filter structure and flowing through the electrostatic filter, past the plates. Plates of both groups are electrically conductive plates that are made of, for example, electrically conductive plastic or other suitable material. A first group of plates is arranged into a first electric potential and a second group of plates is arranged into a second electric potential so that there is a potential difference between two adjacent plates and an electric field is formed between two adjacent plates. The formed potential difference may be, for example, 4 kV-10 kV. For example, if the first electric potential is earth, the second electric potential may be negative or positive high voltage or vice versa or if the first electric potential is negative high voltage, the second potential may be positive high voltage, or vice versa. Plates that are arranged into negative or positive high voltage are connected to a corresponding DC high voltage source, for example, −4 kV to −10 kV or +4 kV to +10 kV. Plates that are arranged into earth potential are connected to a ground voltage source i.e. plates are grounded. Plates of the second group of plates are electrically separated compared to the first group of plates. There is a voltage difference between the plates of the first group and the second group and an electric field is formed between plates. The plates are charged and grounded so that in a case of an electrically conductive rack, the rack is connected to the voltage source. But if electrically conductive adhesive is arranged in the slot of an electrically conductive rack, it is possible that the rack is connected to the voltage source and/or electrically conductive adhesive is connected to the voltage source. Whereas, if electrically conductive adhesive is arranged in the slot of a non-conductive rack, the adhesive is connected to the voltage source. It is possible that both ends of the rack are connected to the voltage source.

Plates of an electrostatic filter form a stack, wherein every second plate of the stack is in the first electric potential and every second plate is in the second electric potential. Electrically charged particles of the gas stream are attracted to the plates with different charge, also referred to as collection plates. If particles are positively charged, they are collected by negatively charged plates or grounded plates of the filter and if particles are negatively charged, they are collected by positively charged plates or grounded plates. In other words, charged particles are led into the filter, in which the separation of the particles from the gas stream is effected primarily by electric forces of an electric field. In order to hold the concentric elements at the appropriate distance apart and electrically insulated and/or in order to provide a DC voltage supply and/or ground connection, racks according to the invention are used.

A rack according to the invention is a supporting structure for plates made of electrically conductive or non-conductive material, for example, plastic or other suitable material, for example, activated carbon or other material that is coated by some suitable material. A rack according to the invention may be used for supporting plates and/or also as a voltage supply mean. The material used may depend on the intended use of the rack in question; for example, for a supporting structure non-conductive material may be used whereas for a voltage supply rack electrically conductive material may be used. However, in some cases it may be possible to use electrically conductive material for a supporting structure and electrically non-conductive material for a voltage supply rack, if electrically conductive adhesive is used. The electrically conductive adhesive may be any material suitable to be used in a slot of the rack for attaching the plates to the rack.

The rack has an elongated shape and it comprises a plurality of notches on a longitudinal side of the rack. The notches are arranged perpendicular to the longitudinal direction of the rack. An edge of a plate may be arranged, for example, to every other notch of the rack so that plates are one on the other if similar racks are used for supporting plates in both potentials. Or plates may be arranged to every notch of the rack, if racks are formed so that racks supporting plates in the first electric potential have notches in different height than racks supporting plates in the second electric potential and plates in different potentials settle so that overlapping plates are in different potential. Each plates supported by the same rack are arranged into the same electric potential. Plates may be attached in place to the rack by electrically non-conductive adhesive if the rack is made of electrically nonconductive material, and by electrically conductive adhesive, if the rack is made of electrically conductive material. The adhesive may be made of electrically conductive or non-conductive material, for example, plastic that is smelted before it is arranged to a slot of the rack. The material of adhesive may be the same material as the material of the rack. The slot is on the opposite side of the rack than notches. The slot may extend from a first end area of the longitudinal rack to the second end area of the rack. Usually, the slot may not extend to the very ends of the rack, because the rack further comprises a connecting structure in both ends of the rack for connecting the rack to a supporting structure on an electrostatic filter. The slot may be arranged at that point of the rack comprising the notches. The adhesive may be used for fastening the plates to the rack. And when the rack and adhesive are made of resistive material that is electrically non-conductive, the plates that are attached to the rack are insulated from each other, but when the rack and/or adhesive are electrically conductive, the plates are arranged to the same electric potential.

In an electrostatic filter there is a plate arranged in the second electric potential between two plates in the first electric potential that are arranged in the rack. For example, if plates arranged in the rack are grounded i.e. in the first electric potential, the plate between the grounded plates is charged in to the second electric potential. The plates in the second electric potential are also attached to the rack, which is different than where the grounded plates are attached to. Furthermore, in order to avoid accidental coupling of the plates having different potentials, there is an opening in the plates at that points where the plates are aligned with racks but are not arranged to be attached to them. This means that the plate that is not arranged to be attached to the rack is clearly arranged apart from the rack i.e. there is a distance between an edge of the plate and the rack into which the plate is not arranged to be attached. The distance between the plate and the rack is arranged such that the breakdown voltage is not exceeded and/or that other electrical leakages are minimised. Possible distance may be for example, 1-15 mm, for example, 4 mm. The distance between overlapping plates may be the same as the distance between the unconnected plate and rack. Therefore, due to the opening it is less likely that unintentional coupling happens between the overlapping plates being in different potential even if the moisture accumulates or plates get dirty. The filter structure according to the embodiments of the invention has an improved ability to cope with moisture and dirt accumulating on the plates and racks, because parts, for example, plates in different potentials will not come into contact despite the accumulated moisture and dirt. Each plate may be connected to several racks arranged in a distance from each other. There may be a rack comprising plates in the second electric potential between those racks comprising plates in the first electric potential. Racks are a supporting structure arranged to support the plates so that they stay within the desired distance from plates above and/or below it, but they also makes the filtering structure sturdy and keep it in shape.

In addition to supporting, a rack according to an embodiment of the invention may act as a voltage supply mean i.e. as a voltage connecting structure as already stated above. The desired DC voltage can be brought to the plates connected to the rack by using electrically conductive adhesive in a slot of an electrically conductive or non-conductive rack or if the rack is made of electrically conductive material, it may be possible that there is no need to use electrically conductive adhesive in a slot of the rack or adhesive at all, but the electrically conductive rack acts as a voltage connecting structure as such. The rack acting as a voltage connecting structure is then connected to an electric source i.e. DC voltage source providing the desired voltage for plates. The desired potential may be for example the ground or a voltage, for example, between 4 kV-10 kV or −4 kV-−10 kV.

It should be noted that a rack according to embodiments of the invention may be further arranged to support other type of plate like elements, for example, activated carbon filter plates or plastic, ceramic, metallic etc. plates which are coated, instead of or in addition to electrostatic filter plates so that a gas filter is formed. Also these plates, when attached to the rack, are arranged essentially as a stack at a predetermined distance from each other and essentially parallel to the flow direction of gas flow arranged to be purified by gas filter and flowing through the gas filter, past the plates. The gas filter is suitable to purify different type of impurities from the gas flow.

FIG. 1 shows a rack 10 for an electrostatic filter of an air purification device according to an embodiment of the invention in a perspective view. The rack 10 is a longitudinal member made of electrically non-conductive or conductive material, for example, plastic, depending on the intended use of the rack. In a first longitudinal side of the rack 10 comprises a plurality of notches 11 arranged perpendicular to the longitudinal direction of the rack 10. Electrostatic filter plates are arranged to be positioned and attached into at least a part of these notches 11, for example, to every second notch 11, and perpendicular to the longitudinal direction of the rack. Every plate that is attached to the rack is arranged to the same electric potential. The opposite longitudinal side of the rack 10, the second longitudinal side, comprises a slot 12 for adhesive. The adhesive may be electrically non-conductive adhesive arranged to attach the plates in place. However, when the adhesive is used, in addition to or instead of attaching the plates, as an electric connector through which the electric potential is provided to plates, the adhesive in the slot 12 is electrically conductive. Both ends of the rack 10 comprise a connecting structure 13. The connecting structure 13 is used for connecting the rack 10 to a supporting structure on an electrostatic filter. It is also possible that there is no need to use adhesive in the slot 12 in some embodiments of the invention.

Figure 2A:
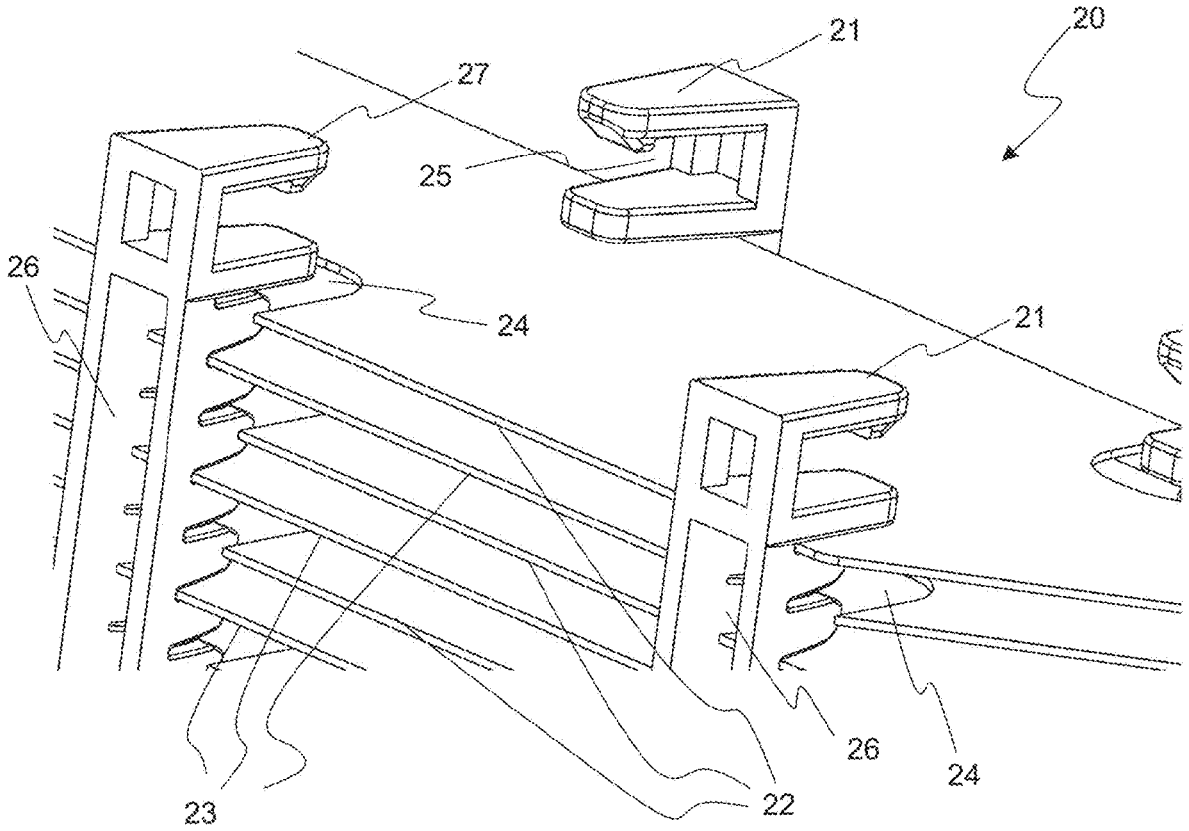
FIG. 2*a, b* shows parts of an electrostatic filter according to an embodiment of the invention in a perspective view.

FIG. 2*a* shows a part of an electrostatic filter 20 according to an embodiment of the invention in a perspective view. The electrostatic filter 20 comprises several electrically non-conductive racks 21, 27 for supporting plates. A first part of racks 21 is arranged to support plates of a first group 22 and a second part of racks 27 is arranged to support plates of a second group 23, wherein plates of the first group 22 are arranged in the first electric potential and the second group 23 are arranged in the second electric potential, wherein the first electric potential is different than the second electric potential. As can be seen from FIG. 2*a*, plates of the first group 22 are attached to a first part of the racks 21, and plates of the second group 23 are attached to a second part of the racks 27. There is an opening 24 in a plate 22, 23 at that point where the plate 22, 23 is aligned with the rack 27, 21 but is not attached to that. One plate 22, 23 usually comprises several openings 24. Ends of the racks 21 comprise a connecting structure 25 arranged to be connected to a supporting structure (not shown) of the electrostatic filter 20.

Plates 22, 23 may be attached in place in the racks 21, 27 by using electrically non-conductive adhesive in a slot 26 of the racks 21, 27 arranged on the opposite side of the rack 21, 27 from the notches. The adhesive fastens the plates on place.

Plates of both groups 22, 23 are electrically conductive plastic plates. The distance between the overlapping plates is arranged such that the air can flow through plates 21, 27 and an adequate electric field can be provided between plates 21, 27.

Figure 2B:
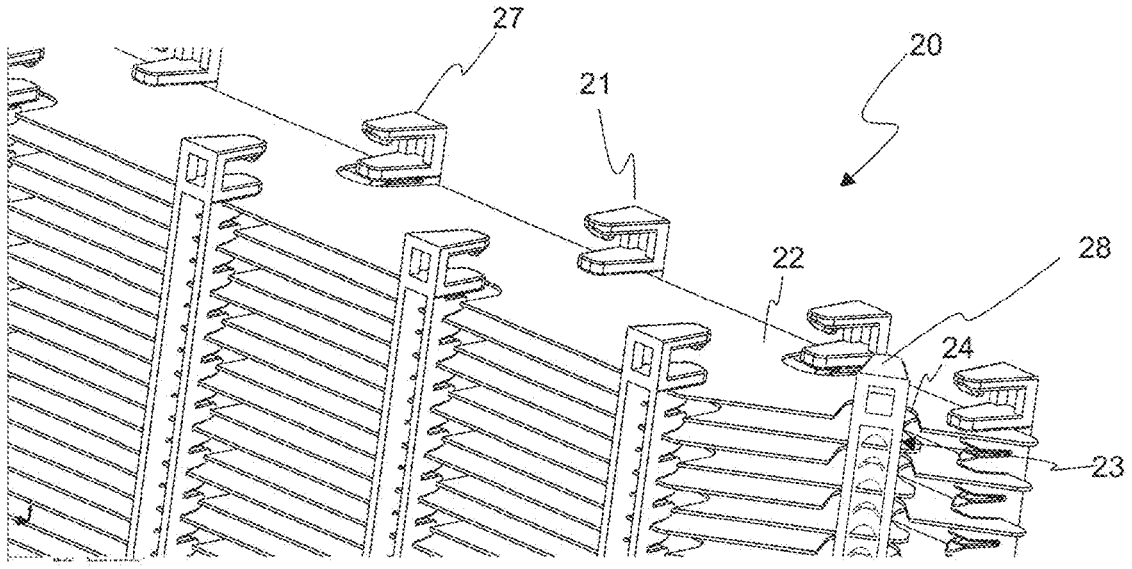

FIG. 2*b* shows a bigger part of the electrostatic filter 20 according to an embodiment of the invention in a perspective view. In this embodiment there is also shown a rack 28 used for supplying electric voltage for the second group of plates 23. There is also an opening 24 in the first group of plates 22 at that point where the plates 22 are aligned with the voltage supply rack 28 but which are not attached to that rack 28. The adhesive used in the slot of the voltage supply rack 28 is electrically conductive.

Figure 3A:
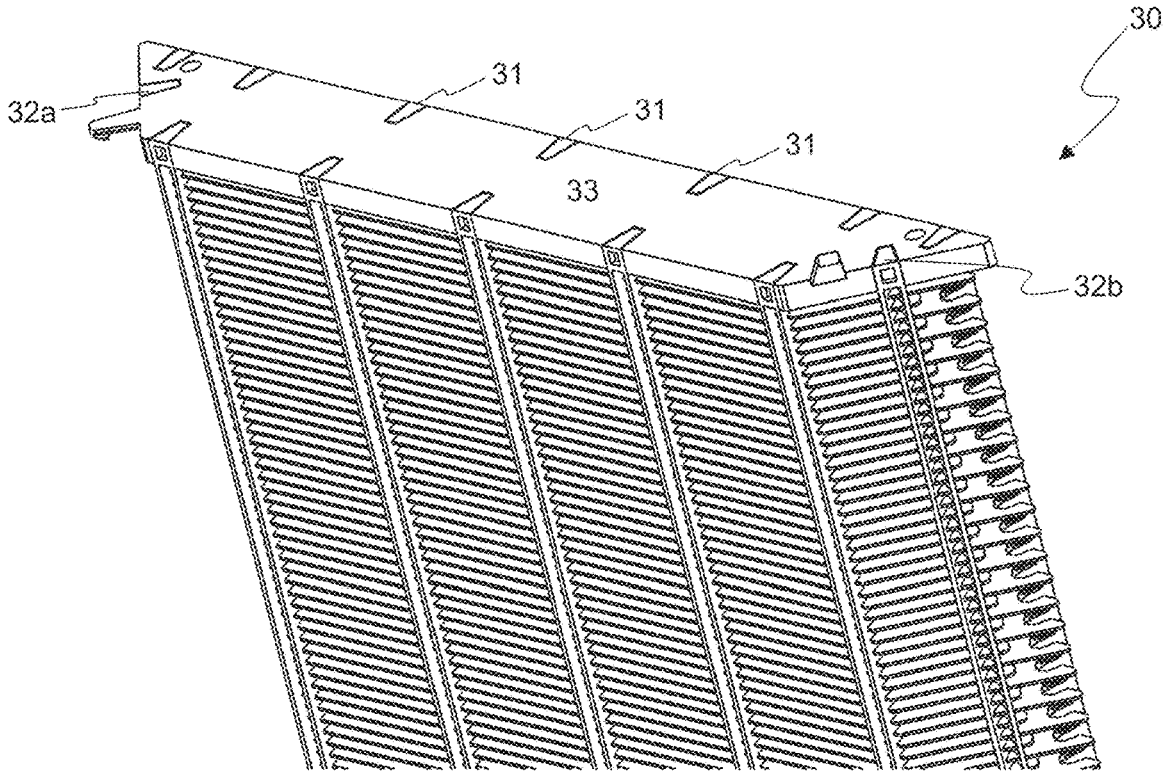
FIG. 3*a* shows a part of an electrostatic filter according to an embodiment of the invention in a perspective view.

FIG. 3*a* shows a part of an electrostatic filter 30 according to an embodiment of the invention in a perspective view. The electrostatic filter 30 comprises several racks 31, a voltage supply rack 32*a* for arranging the plates that are attached to it into a first electric potential, a voltage supply rack 32*b* for arranging the plates that are attached to it into a second electric potential, and a cover 33 into which connecting means of the racks 31, 32*a*, 32*b* are attached. The cover 33 is made of electrically non-conductive material, for example, electrically non-conductive plastic. There is also a corresponding cover (not shown) into which connecting means of the other ends of the racks 31, 32*a*, 32*b* are attached. The filter 30 may be used as such or it may be used as a part of a larger electrostatic filter entity i.e. a combined electrostatic filter comprising more than one electrostatic filter, for example, filters corresponding to the electrostatic filter 30 of FIG. 3*a*. The combined electrostatic filter acts still as a one electrostatic filter. The shape of an electrostatic filter may also be other than shown in the embodiments of the invention. It may be, for example rectangular.

Figure 3B:
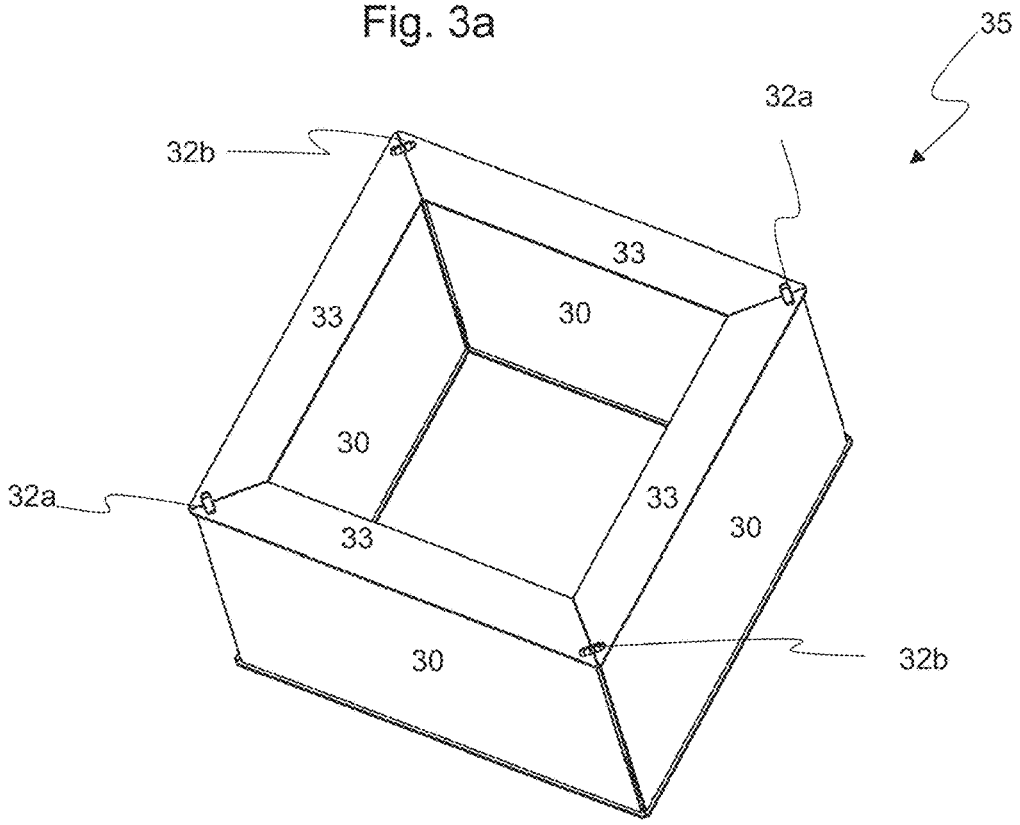
FIG. 3*b* shows an electrostatic filter according to an embodiment of the invention in a perspective view.

FIG. 3*b* shows a combined electrostatic filter according to an embodiment of the invention in a perspective view. The combined electrostatic filter 35 comprises four similar separate electrostatic filters 30 corresponding to electrostatic filters 30 shown in FIG. 3*a*. The shape of electrostatic filters 30 is such that they are suitable to be arranged in a box-like-shape i.e. as a quadrangle, wherein each of the four sides is an electrostatic filter 30. Electrostatic filters 30 may be connected to each other in different ways so that different combined filter shapes are formed, the electrostatic filters 30 may be arranged, for example, one next to each other, or there may be only 2 or 3 filters in a larger electrostatic filter. The combined electrostatic filter 35 comprising more than one separate electrostatic filters 30 may also be formed in shape in which it is arranged to be used at the place of use. This offers the advantage that the storage and transportation of combined electrostatic filters 35 comprising more than one separate electrostatic filters 30 is easier and cheaper. Other examples of possible shapes of electrostatic filters and combined electrostatic filters according to embodiments of the invention are show in FIG. 6*a-f*. An electrostatic filter may be connected to at least one other electrostatic filter by any suitable connecting device. The connecting device may be, for example, a clip, glue, tape, Velcro, magnet, pin-hole-device etc.

Figure 4:
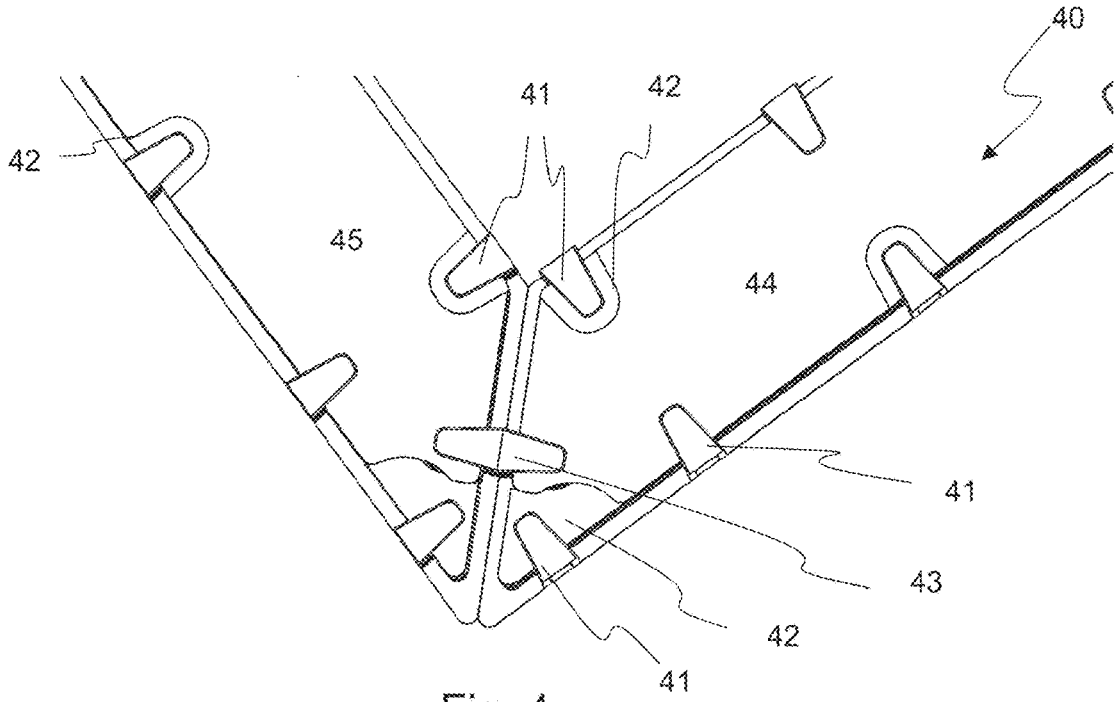
FIG. 4 shows a part of an electrostatic filter according to an embodiment of the invention from above.

FIG. 4 shows a part of an electrostatic filter according to an embodiment of the invention from above. In this embodiment is shown a corner structure of a combined electrostatic filter 40 comprising two separate electrostatic filters 44, 45 that are connected together. Because the structure of the electrostatic filters 44, 45 is such that a right-angle may be formed so that both electrostatic filters 44, 45 form a half of the corner structure of the combined electrostatic filter 40 and because the electrostatic filters 44, 45 do not comprise a frame structure surrounding the electrostatic filters 44, 45, the air may flow through the whole corner structure of the electrostatic filter 40 relatively unrestricted and therefore substantially the whole corner structure of the combined electrostatic filter 40 may filter the air flow. This kind of corner structure provides more surface area for the combined electrostatic filter 40. The larger surface area provides better filtering efficiency. Furthermore, this kind of corner structure is a structure that does not enable air to flow past the combined filter 40 like some existing corner structures of filters i.e. air cannot flow through the combined filter 40 without being filtered.

Figure 5A:
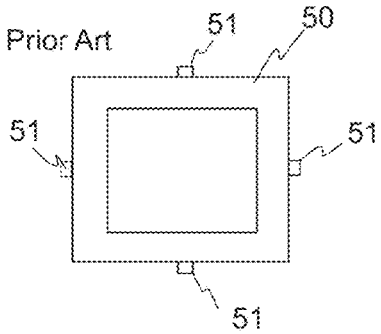
FIG. 5*a-b* show prior art voltage supply connections of an electrostatic filter.
Figure 5B:
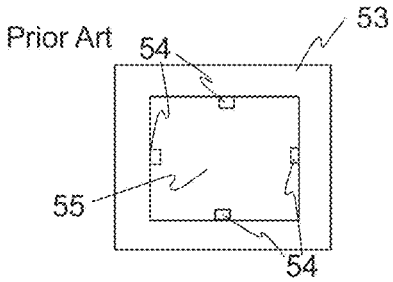

FIGS. 5*a* and 5*b* show prior art voltage supply connections of an electrostatic filter. Traditionally voltage supply connections are arranged on the outer or inner surface of an electrostatic filter. In the FIG. 5*a*, the supply connections 51 are arranged on the outer surface of the electrostatic filter 50, which may not work properly, because the supply connections 51 may easily and unintentionally be in connection with metallic structures of an air purification device inside which the electrostatic filter 50 is arranged. Therefore, this structure may lead to problems. In the FIG. 5*b*, the supply connections 54 are arranged on the inner surface of the electrostatic filter 53.

In this case, the non-purified gas stream touches the supply connections 54 on its way to the electrostatic filter 53 for purifying via an opening 55 formed in the middle of the filter parts of the filter 53 towards the outer surfaces of the filter parts. The particles may foul the supply connections 54, which may lead to a short circuit or short circuits. Short circuits are more likely formed when particles absorb moisture in them. It should be noted that also structure of FIG. 5*a* may lead to unwanted short circuits, when air touches the supply connections 51 on its way to the electrostatic filter 50 for purifying from the outside of the filter 51 towards the interior of the filter 50

Figure 5C:
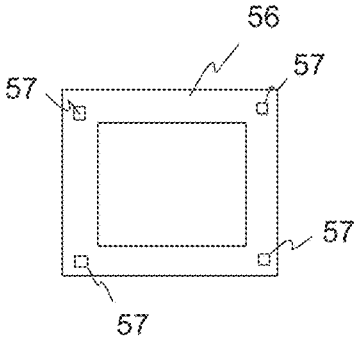
FIG. 5*c* shows voltage supply connections of a combined electrostatic filter according to an embodiment of the invention from above.

FIG. 5*c* shows voltage supply connections 57 of a combined electrostatic filter 56 according to an embodiment of the invention from above. In this embodiment the voltage supply connections 57 are arranged, as voltage supply racks, inside the electrostatic filter 56. This is preferable, because now the voltage supply connections 57 do not foul or touch to the metallic structures of an air purification device inside which the electrostatic filter 56 is arranged. Furthermore, when voltage supply connections 57 are arranged inside the electrostatic filter 56 moisture and dirt accumulating on racks is less.

Figure 6A:
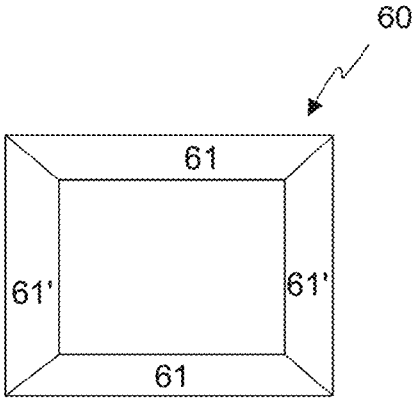
FIG. 6*a-f* show filters and combined filter structures according to an embodiment of the invention from above.
Figure 6B:
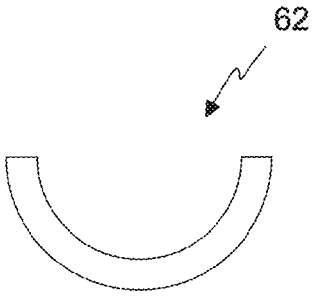

FIGS. 6*a-f* show filters and combined filter structures according to embodiments of the invention from above. FIG. 6*a* shows a rectangular combined electrostatic filter 60 according to an embodiment of the invention. The combined electrostatic filter 60 comprises four separate electrostatic filters, two of them are larger electrostatic filters 61 and two are smaller electrostatic filters 61'. Filters of a combined electrostatic filter do not need to be same size or shape. FIG.

Figure 6C:
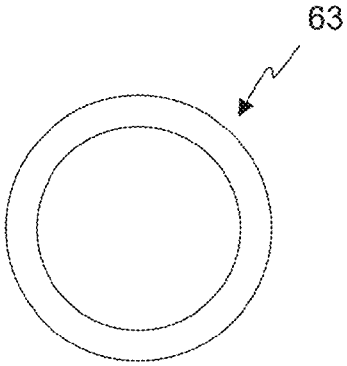
Figure 6D:
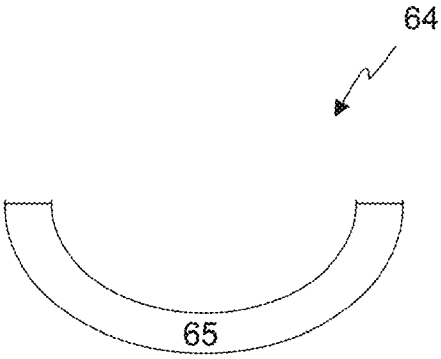
Figure 6E:
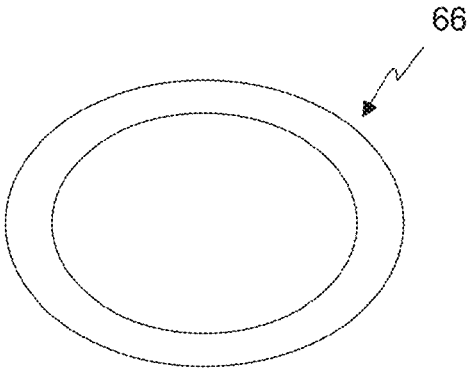
Figure 6F:
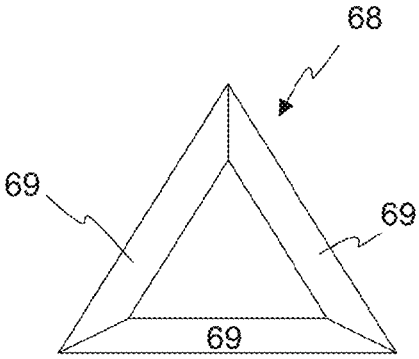

6*b* shows an electrostatic filter 62 according to an embodiment of the invention having a shape of a half circle. It is possible to combine this filter to other electrostatic filter also having a shape of half circle so that a circle combined filter is formed. FIG. 6*c* shows an electrostatic filter 63 according to an embodiment of the invention having a shape of a circle. FIG. 6*d* shows an electrostatic filter 64 according to an embodiment of the invention having a shape of a half oval. It is possible to combine this filter to other electrostatic filter having also a shape of a half oval so that an oval combined filter is formed. FIG. 6*e* shows an electrostatic filter 66 according to an embodiment of the invention having a shape of an oval. FIG. 6*f* shows a combined electrostatic filter 68 according to an embodiment of the invention having a shape of a triangular. The combined electrostatic filter 68 comprises three separate electrostatic filters 69 that are connected to each other.

It should be noted that the shape of an electrostatic filter and a combined electrostatic filter may be freely selected according to intended use and/or location of an electrostatic filter and a combined electrostatic filter. The shape is no limited any way.

In addition to the above-mentioned it is possible to add, for example, by adhesive, an electrical connector to one or more notches of a rack and/or to at least one end or side of the rack.

It is obvious that the present invention is not limited solely to the above-presented embodiments, but it can be modified within the scope of the appended claims.

The invention claimed is:

1. A frameless electrostatic filter comprising a plurality of racks and a plurality of electrically conductive filter plates arranged as a stack with one plate on another; each of the plurality of racks comprising:

an elongated member comprising a plurality of notches on a longitudinal side of the rack for supporting one of the electrically conductive filter plates arranged to a notch, and comprising a connecting structure in both ends of the rack for connecting the rack to supporting structures of the frameless electrostatic filter;

a slot for adhesive arranged for attaching the electrically conductive filter plates to the rack a side of the rack opposite from the plurality of notches;

wherein the rack is made of electrically conductive material, or the rack is made of non-electrically conductive material;

wherein when the rack is made of electrically conductive material, the rack supports the electrically conductive filter plates and is an electric voltage supply for the electrically conductive filter plates, and when the rack is made of non-electrically conductive material, in addition to acting as a supporting structure for the electrically conductive filter plates, the rack acts as an electric voltage supply for the electrically conductive filter plates attached to the rack by electrically conductive adhesive arranged in the slot, or the rack acts only as a supporting structure for electrically conductive filter plates attached to the rack without the adhesive or by non-electrically conductive adhesive arranged in the slot; and wherein a first group of the plurality of electrically conductive filter plates is arranged into a first electric potential and a second group of the plurality of electrically conductive filter plates which are different from the first group of the plurality of electrically conductive filter plates, are arranged into a second electric potential, and wherein a first group of the racks are arranged to support only the first group of the plurality of electrically conductive filter plates and a second group of the racks are arranged to support only the second group of the plurality of electrically conductive filter plates so that each rack of the plurality of racks supports a corresponding electrically conductive filter plate and each electrically conductive filter plate is supported by the plurality of racks, and wherein every other electrically conductive filter plate of the stack is arranged alternately between the first electric potential and the second electric potential so that an electric field is formed between the plurality of electrically conductive filter plates, and wherein an opening is formed in the plurality of electrically conductive filter plates at a point where the plurality of electrically conductive filter plates are aligned with one of the plurality of racks but are not arranged to be attached to the one of the plurality of racks, and wherein at least one rack of the first group of the plurality of racks is arranged to supply first electric voltage to the first group of the plurality of electrically conductive filter plates and at least one rack of the second group of the plurality of racks is arranged to supply second electric voltage to the second group of the plurality of electrically conductive filter plates, and wherein the frameless electrostatic filter comprises a supporting structure above and under the frameless electrostatic filter.

2. The frameless electrostatic filter according to claim 1, wherein the electrically conductive adhesive is in the slot of racks being at least a part among the slots arranged to provide electric voltage for the plurality of electrically conductive filter plates.

3. The frameless electrostatic filter according to claim 1, wherein the non-electrically conductive adhesive attaches electrically conductive filter plates to the slot being at least a part among the slots of racks arranged to support the electrically conductive filter plates.

4. The frameless electrostatic filter according to claim 1, wherein the frameless electrostatic filter is connected to another frameless electrostatic filter for forming a combined frameless electrostatic filter.

5. The frameless electrostatic filter according to claim 1, wherein the frameless electrostatic filter is connected to another frameless electrostatic filter so that a right-angle is formed so that both of the frameless electrostatic filters form a half of a corner structure of the combined frameless electrostatic filter.

6. The frameless electrostatic filter according to claim 4, wherein the racks arranged to provide electric voltage for the plurality of electrically conductive filter plates are arranged inside the combined frameless electrostatic filter.

* * * * *